US008312663B2

(12) United States Patent
Johnson

(10) Patent No.: US 8,312,663 B2
(45) Date of Patent: Nov. 20, 2012

(54) SYSTEM AND METHOD FOR IMPROVING PERFORMANCE OF A WEAPON BARREL

(76) Inventor: Christopher David Johnson, Crawfordsville, IN (US)

( * ) Notice: Subject to any disclaimer, the term of this patent is extended or adjusted under 35 U.S.C. 154(b) by 0 days.

(21) Appl. No.: 12/727,074

(22) Filed: Mar. 18, 2010

(65) Prior Publication Data

US 2011/0107647 A1 May 12, 2011

Related U.S. Application Data

(60) Provisional application No. 61/161,370, filed on Mar. 18, 2009.

(51) Int. Cl.
*F41A 21/00* (2006.01)
*F41A 21/44* (2006.01)

(52) U.S. Cl. ..... 42/97; 42/76.01; 89/14.05

(58) Field of Classification Search ..... 42/76.01, 42/76.02, 77, 78, 96, 97; 89/14.05, 14.1, 89/16, 14.7, 14.8
See application file for complete search history.

(56) References Cited

U.S. PATENT DOCUMENTS

| | | | | |
|---|---|---|---|---|
| 3,118,243 | A * | 1/1964 | Manshel | 42/76.02 |
| 3,556,889 | A * | 1/1971 | Grahn | 156/91 |
| 4,922,642 | A * | 5/1990 | Ohlhauser | 42/96 |
| 5,778,590 | A * | 7/1998 | Browning et al. | 42/96 |
| 5,794,374 | A | 8/1998 | Crandall | |
| 5,798,473 | A * | 8/1998 | Roblyer et al. | 89/14.3 |
| 6,497,065 | B1 * | 12/2002 | Huston | 42/76.02 |
| 6,516,550 | B1 * | 2/2003 | Schnyder et al. | 42/96 |
| 6,889,462 | B1 | 5/2005 | Carlson | |
| 6,889,464 | B2 * | 5/2005 | Degerness | 42/76.02 |
| 2003/0093935 | A1 * | 5/2003 | Huston | 42/76.02 |
| 2005/0034346 | A1 * | 2/2005 | Smith | 42/76.02 |
| 2007/0062090 | A1 * | 3/2007 | Brindle | 42/96 |
| 2007/0256345 | A1 * | 11/2007 | Hall et al. | 42/76.1 |

* cited by examiner

*Primary Examiner* — Bret Hayes
(74) *Attorney, Agent, or Firm* — Ice Miller LLP

(57) ABSTRACT

A harmonic barrel dampener operable to increase the accuracy of a weapon having a barrel. According to at least one embodiment, a harmonic barrel dampener comprises an outer portion that substantially encases or enwraps a significant portion of barrel, and wherein the harmonic barrel dampener further comprises at least one acoustic dampening material contained between the outer portion and a weapon's barrel, resulting in improved accuracy of projectiles fired from the weapon.

11 Claims, 16 Drawing Sheets

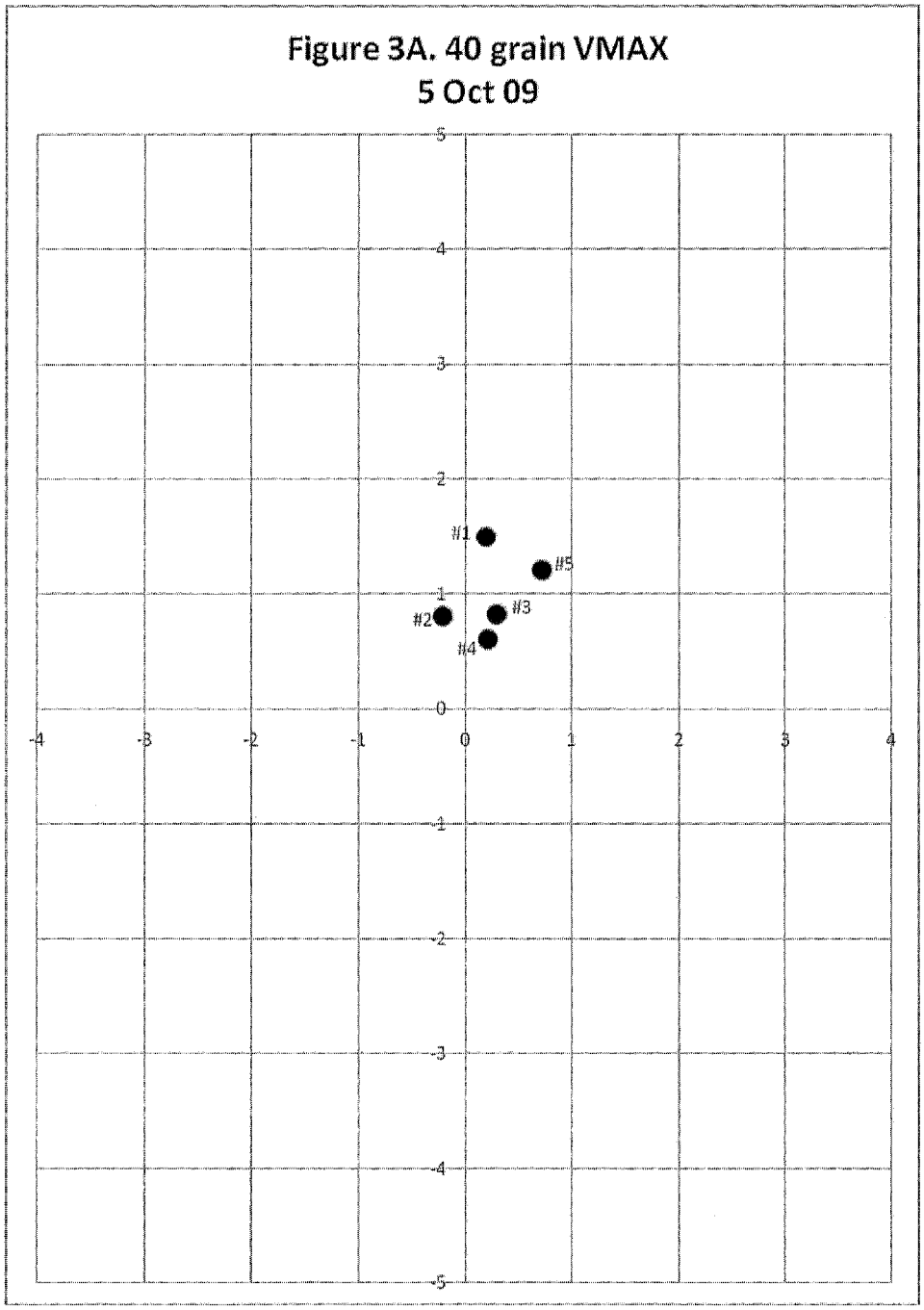
Figure 3A. 40 grain VMAX
5 Oct 09
#1
#2
#3
#4
#5
5
4
3
2
1
0
-1
-2
-3
-4
-5
-4
-3
-2
-1
0
1
2
3
4

Fig. 3B

| Trial | V | X | Y |
|---|---|---|---|
| #1 | Error | 0.20 | 1.50 |
| #2 | 3346 | - 0.20 | 0.80 |
| #3 | 3362 | 0.30 | 0.82 |
| #4 | 3381 | 0.22 | 0.60 |
| #5 | 3432 | 0.73 | 1.20 |

V = Muzzle velocity (feet/second)

X = Deviation from the origin in the X-axis (inches)

Y = Deviation from the origin in the Y-axis (inches)

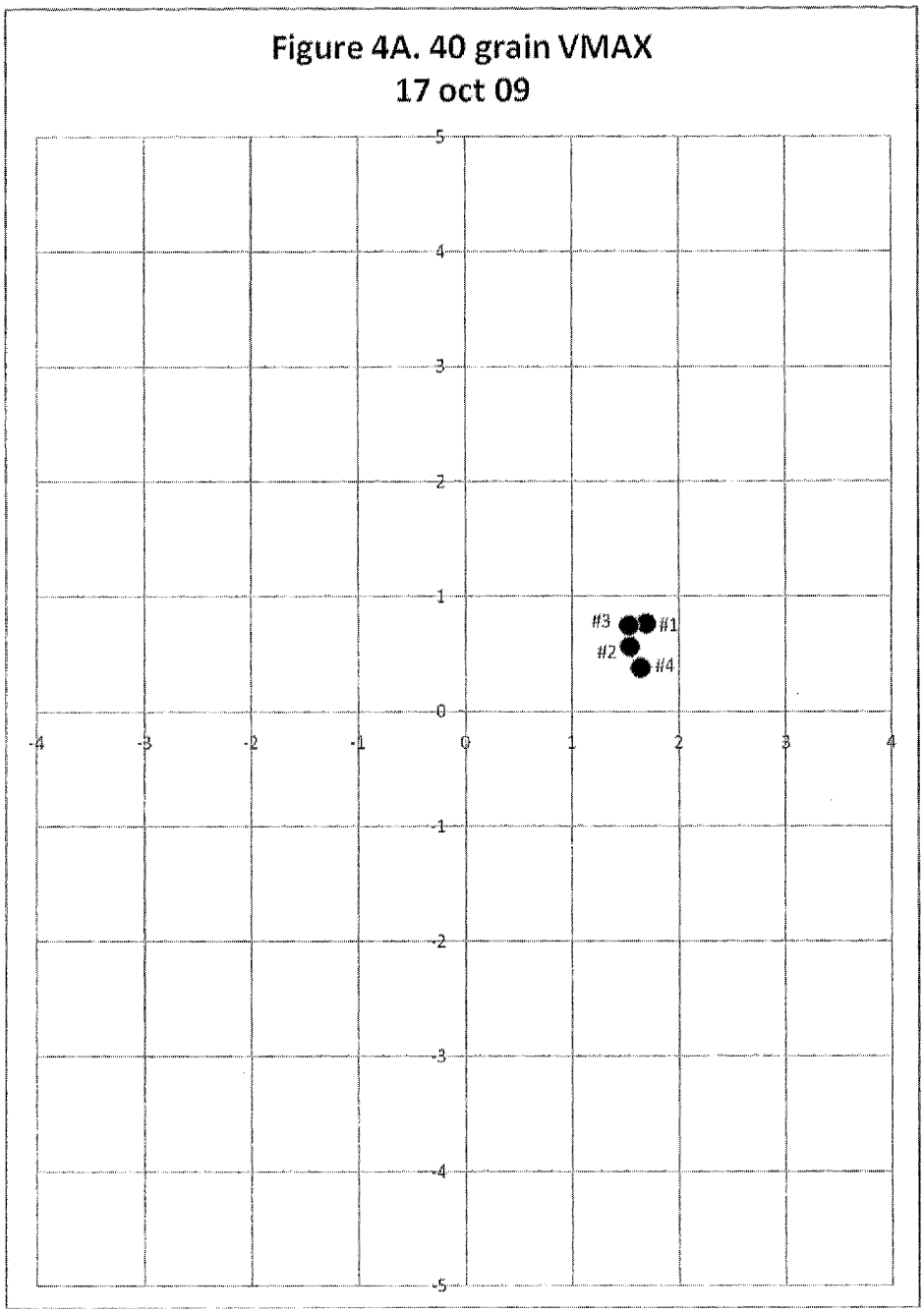
Figure 4A. 40 grain VMAX
17 oct 09
#3
#1
#2
#4
5
4
3
2
1
0
-1
-2
-3
-4
-5
-4
-3
-2
-1
0
1
2
3
4

Fig. 4B

| Trial | V | X | Y |
|---|---|---|---|
| #1 | 3282 | 1.70 | 0.76 |
| #2 | 3284 | 1.55 | 0.56 |
| #3 | 3294 | 1.54 | 0.74 |
| #4 | Error | 1.65 | 0.37 |

V = Muzzle velocity (feet/second)

X = Deviation from the origin in the X-axis (inches)

Y = Deviation from the origin in the Y-axis (inches)

Figure 5A. 55 grain VMAX
5 Oct 09
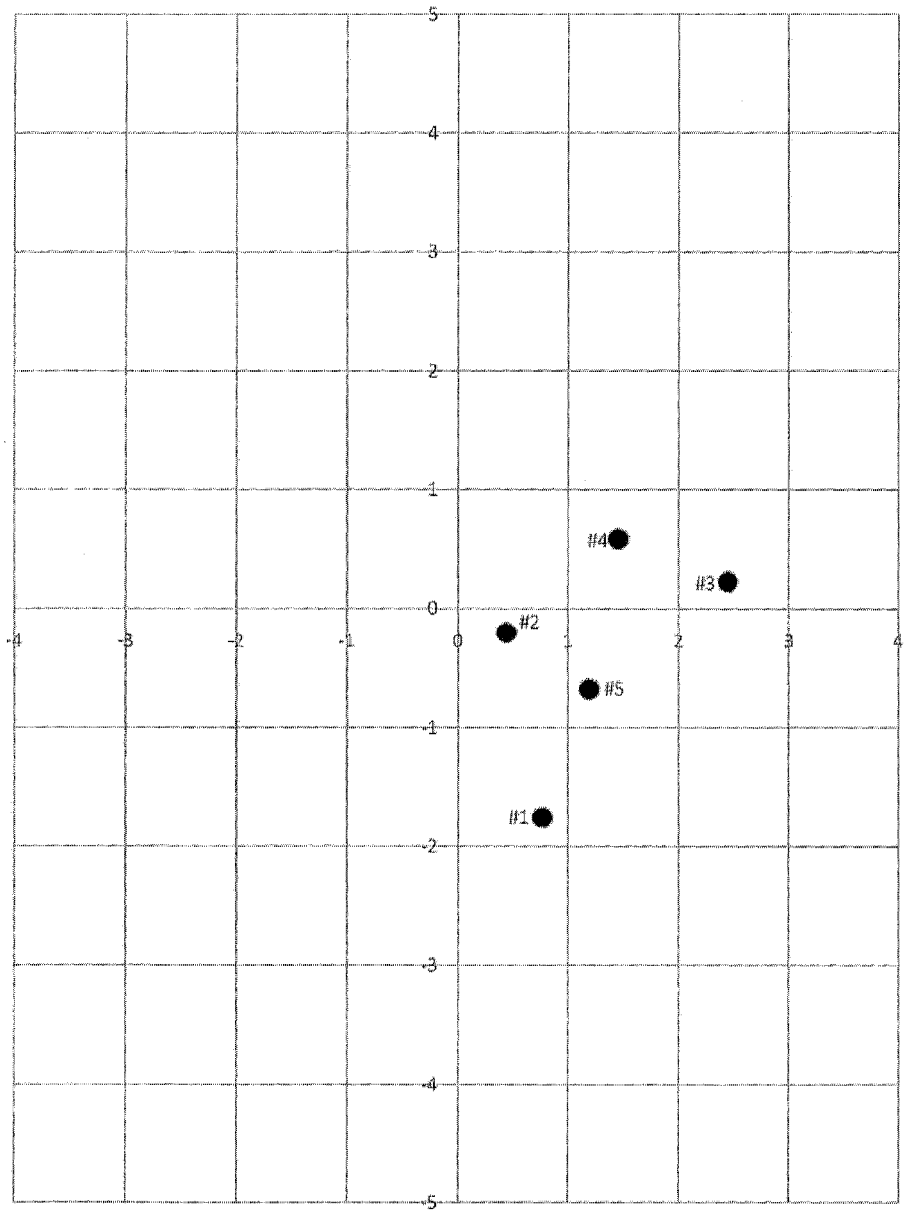

Fig. 5B

| Trial | V | X | Y |
|---|---|---|---|
| #1 | 3334 | 0.77 | - 0.75 |
| #2 | 3220 | 0.45 | - 0.20 |
| #3 | 3303 | 2.44 | 0.22 |
| #4 | 3319 | 1.46 | 0.58 |
| #5 | 3270 | 1.24 | - 0.68 |

V = Muzzle velocity (feet/second)

X = Deviation from the origin in the X-axis (inches)

Y = Deviation from the origin in the Y-axis (inches)

Figure 6A. 55 grain VMAX
17 Oct 09
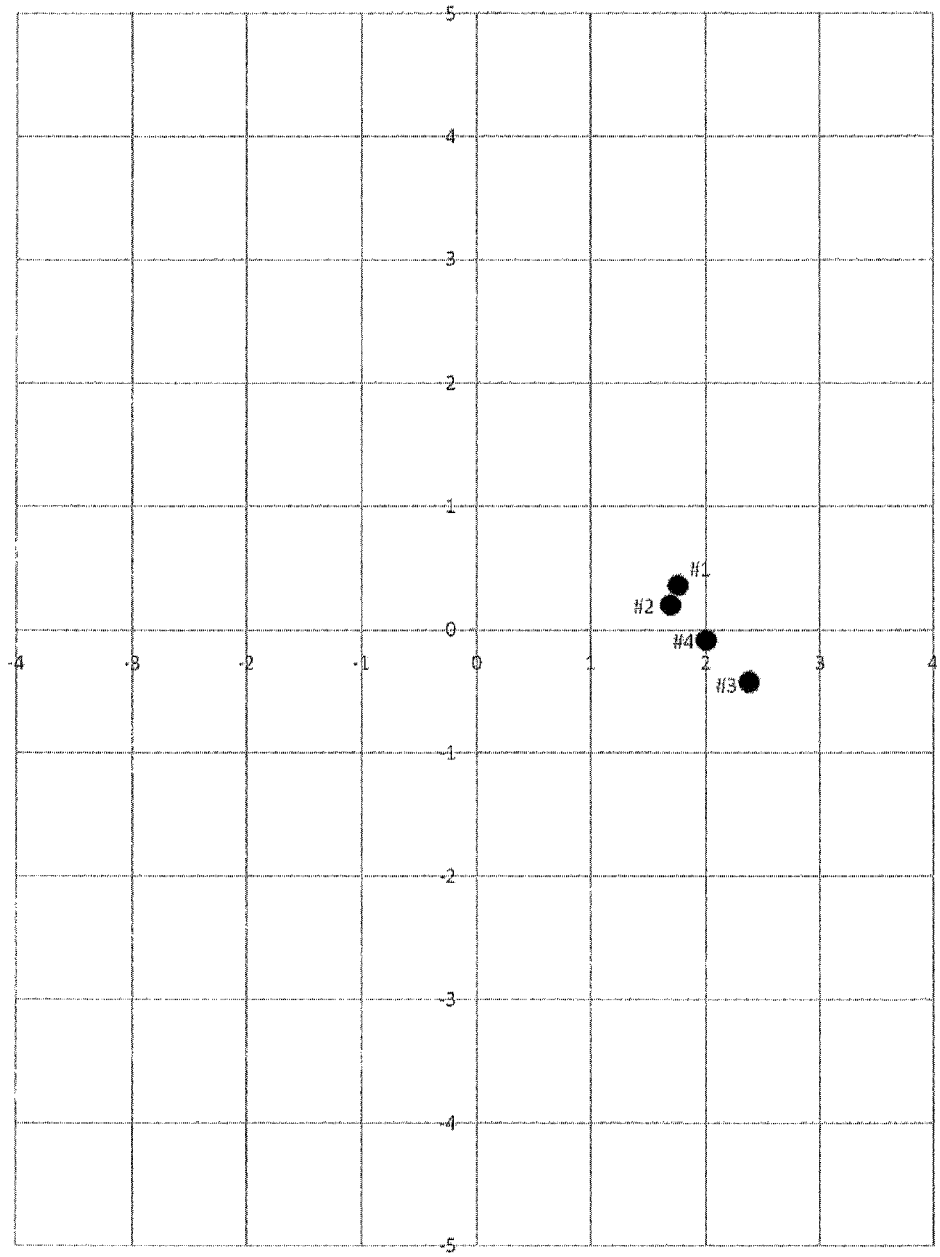

Fig. 6B

| Trial | V | X | Y |
|---|---|---|---|
| #1 | 3306 | 1.77 | 0.36 |
| #2 | 3315 | 1.70 | 0.20 |
| #3 | 3337 | 2.38 | - 0.43 |
| #4 | 3252 | 2.01 | - 0.09 |

V = Muzzle velocity (feet/second)

X = Deviation from the origin in the X-axis (inches)

Y = Deviation from the origin in the Y-axis (inches)

Figure 7A. 168 grain Match
20 June 09
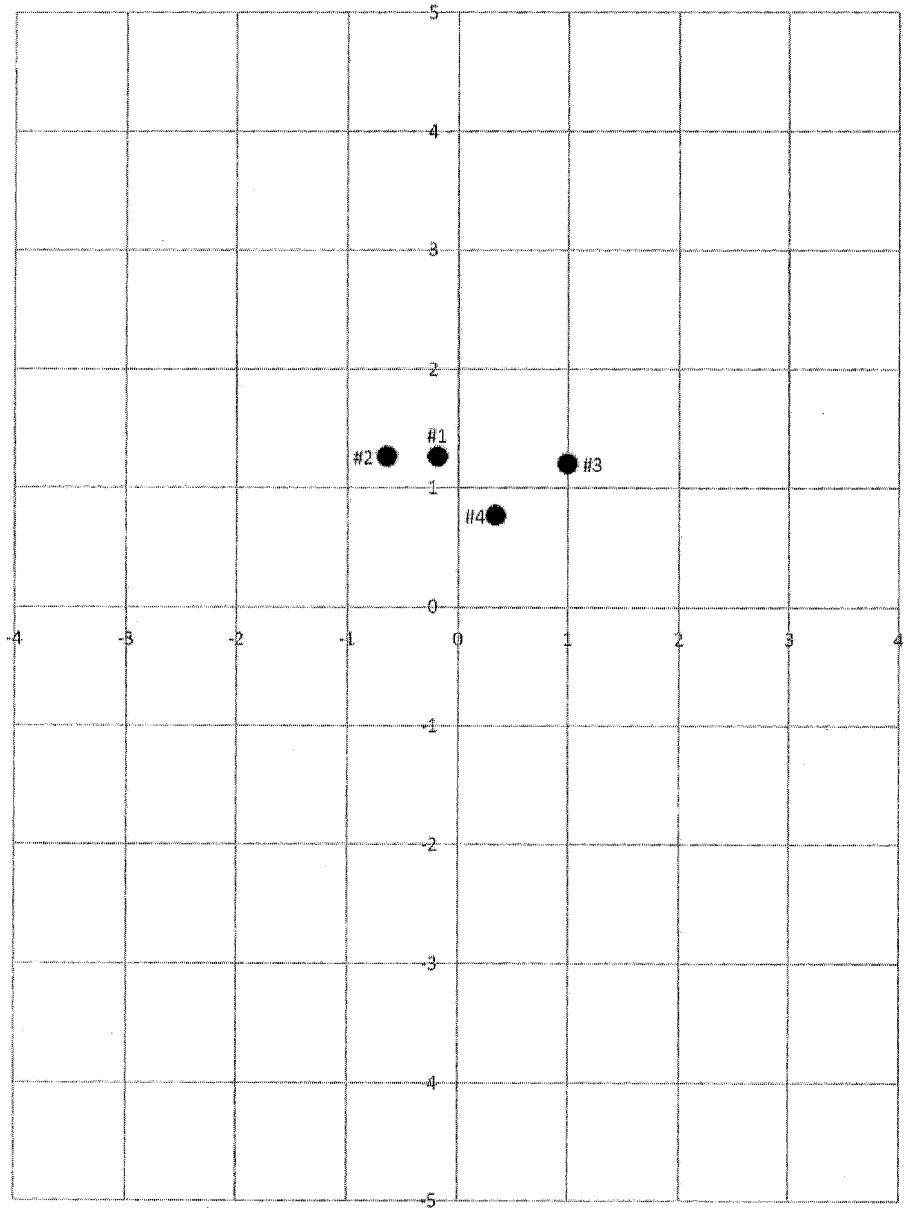

Fig. 7B

| Trial | V | T | X | Y |
|---|---|---|---|---|
| #1 | 2511 | 159.8° | - 0.18 | 1.26 |
| #2 | 2519 | 161.5° | - 0.64 | 1.26 |
| #3 | 2504 | 162.9° | 1.00 | 1.20 |
| #4 | 2511 | 164.2° | 0.35 | 0.77 |

V = Muzzle velocity (feet/second)

T = External barrel temperature ($^{o}$F)

X = Deviation from the origin in the X-axis (inches)

Y = Deviation from the origin in the Y-axis (inches)

Figure 8A. 168 grain Match
11 July 09
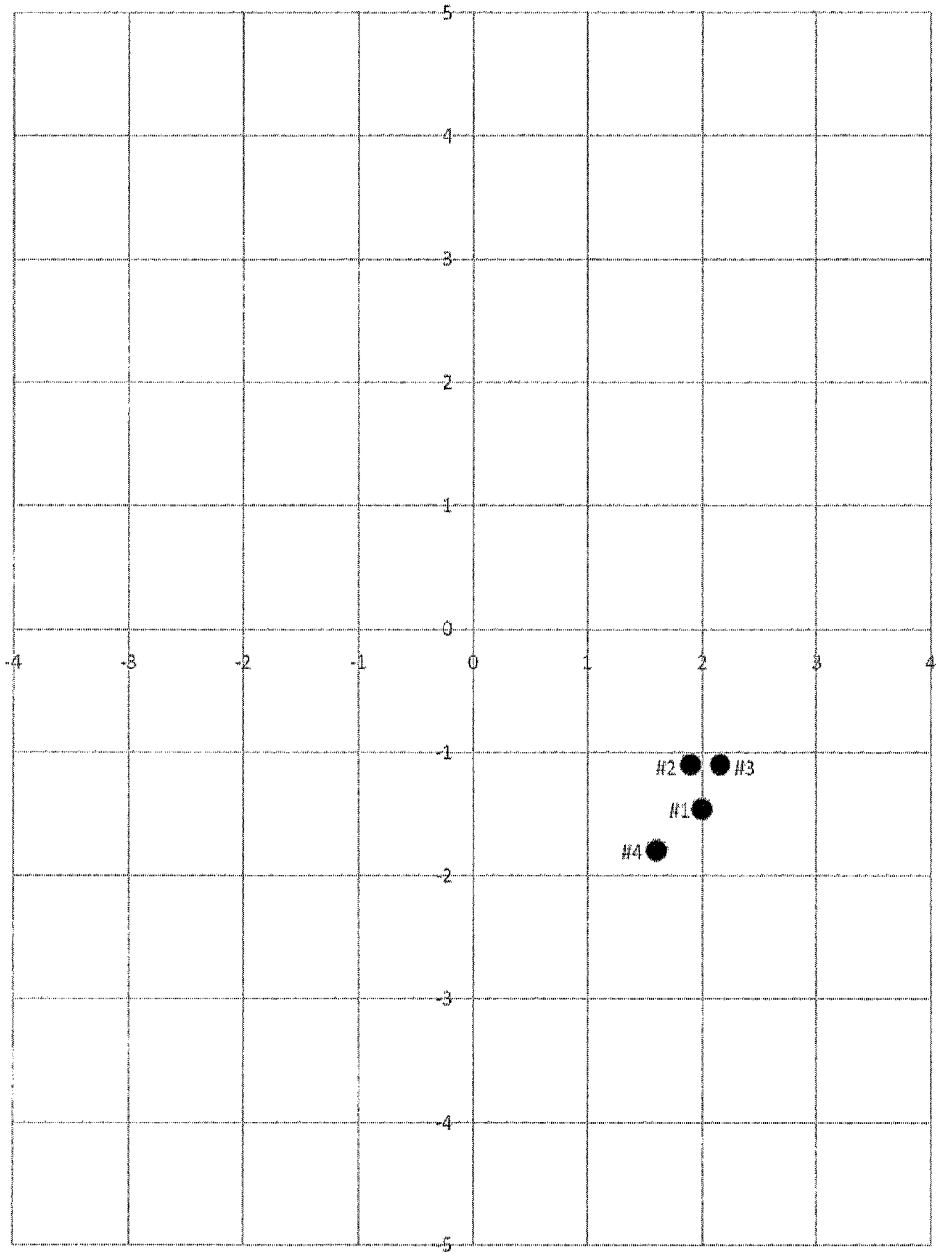

Fig. 8B

| Trial | V | T | X | Y |
|---|---|---|---|---|
| #1 | 2433 | 101.5° | 2.00 | - 1.46 |
| #2 | 2455 | 102.2° | 2.15 | - 1.10 |
| #3 | 2436 | 102.3° | 1.90 | - 1.10 |
| #4 | 2404 | 101.7° | 1.60 | - 1.80 |

V = Muzzle velocity (feet/second)

T = External barrel temperature (°F)

X = Deviation from the origin in the X-axis (inches)

Y = Deviation from the origin in the Y-axis (inches)

Figure 9. Swiss K31 unmodified
172 grain surplus ammunition
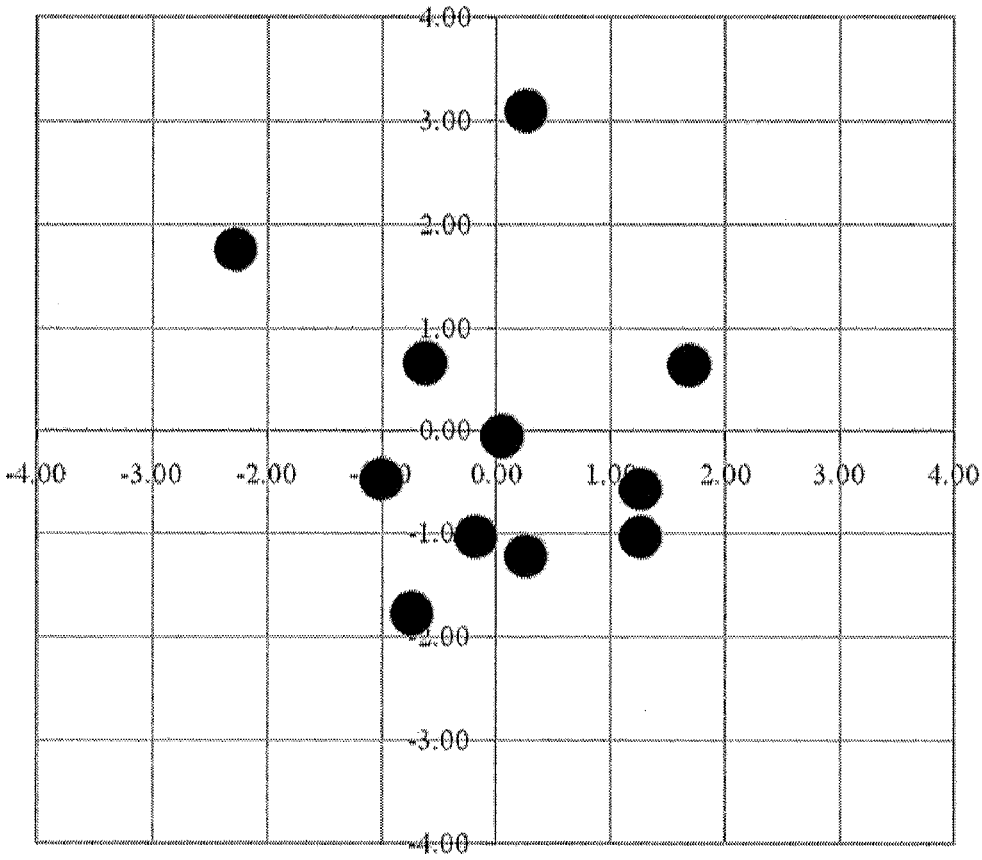

Figure 10. Swiss K31 dampened
172 grain surplus ammunition
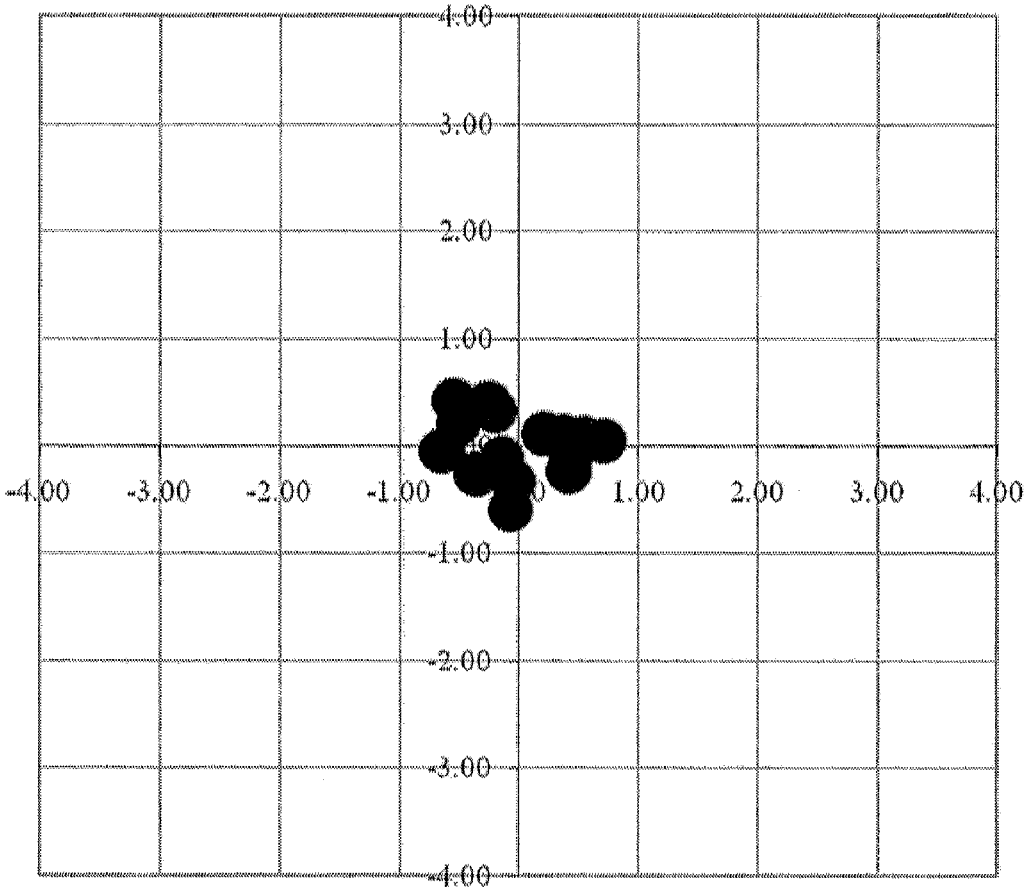

SYSTEM AND METHOD FOR IMPROVING PERFORMANCE OF A WEAPON BARREL

PRIORITY

This application claims priority to U.S. Provisional Patent Application Ser. No. 61/161,370 filed Mar. 18, 2009, titled "Improved Sniper Rifle", the contents of which are incorporated by reference herein.

BACKGROUND

Sniper rifles and other high accuracy guns and artillery are designed to repeatedly deliver a projectile accurately and precisely. However, it will be appreciated that variations within the barrel, including perturbations caused by acoustic disturbances produced through the act of firing, can cause important changes to the trajectory or flight path of a projectile, thereby causing a decrease in accuracy. Currently, methods for reducing such perturbations typically relate to devices operable to mechanically balance a muzzle at the point where the bullet exits the barrel, such as those discussed in U.S. Pat. No. 5,794,374, or the use of movable counterweights such as those marketed under the mark Limbsaver®. Other methods for reducing such perturbations include U.S. Pat. No. 6,889,462 that utilize a leaf spring system for compressing a barrel until its "sweet spot" is found can reduce variability in the accuracy of a weapon barrel. However, it would be appreciated in the art to supply a system and method for reducing the variability induced in a barrel through acoustic disturbances without the need to iteratively tension and/or counterbalance followed by field testing the proper spring loading or counterweight position for each individual barrel and ammunition type.

BRIEF DESCRIPTION OF THE DRAWINGS

FIG. 3A is a copy of a target shot five times by a Thomson Encore® rifle at 100 yards prior to installing a harmonic barrel dampener according to at least one embodiment.

FIG. 3B is table showing the results of the shots in FIG. 3A.

FIG. 4A is a copy of a target shot four times by a Thomson Encore® rifle at 100 yards after installing a harmonic barrel dampener according to at least one embodiment.

FIG. 4B is table showing the results of the shots in FIG. 4A.

FIG. 5A is a copy of a target shot four times by a Thomson Encore® rifle at 100 yards prior to installing a harmonic barrel dampener according to at least one embodiment.

FIG. 5B is table showing the results of the shots in FIG. 5A.

FIG. 6A is a copy of a target shot four times by a Thomson Encore® rifle at 100 yards after installing a harmonic barrel dampener according to at least one embodiment.

FIG. 6B is table showing the results of the shots in FIG. 6A.

FIG. 7A is a copy of a target shot five times by a 1903 Springfield rifle at 100 yards after to installing a harmonic barrel dampener according to at least one embodiment.

FIG. 7B is table showing the results of the shots in FIG. 7A,

FIG. 8A is a copy of a target shot four times by a 1903 Springfield rifle at 100 yards after to installing a harmonic barrel dampener according to at least one embodiment, FIG. 8B is table showing the results of the shots in FIG. 8A.

FIG. 9 is a scatter plot of eleven shots by a Swiss K31 rifle at 100 yards after to installing a harmonic barrel dampener according to at least one embodiment.

FIG. 10 is a scatter plot of fifteen shots by a Swiss K31 rifle at 100 yards after to installing a harmonic barrel dampener according to at least one embodiment.

DETAILED DESCRIPTION

Figures 1A, 1B:
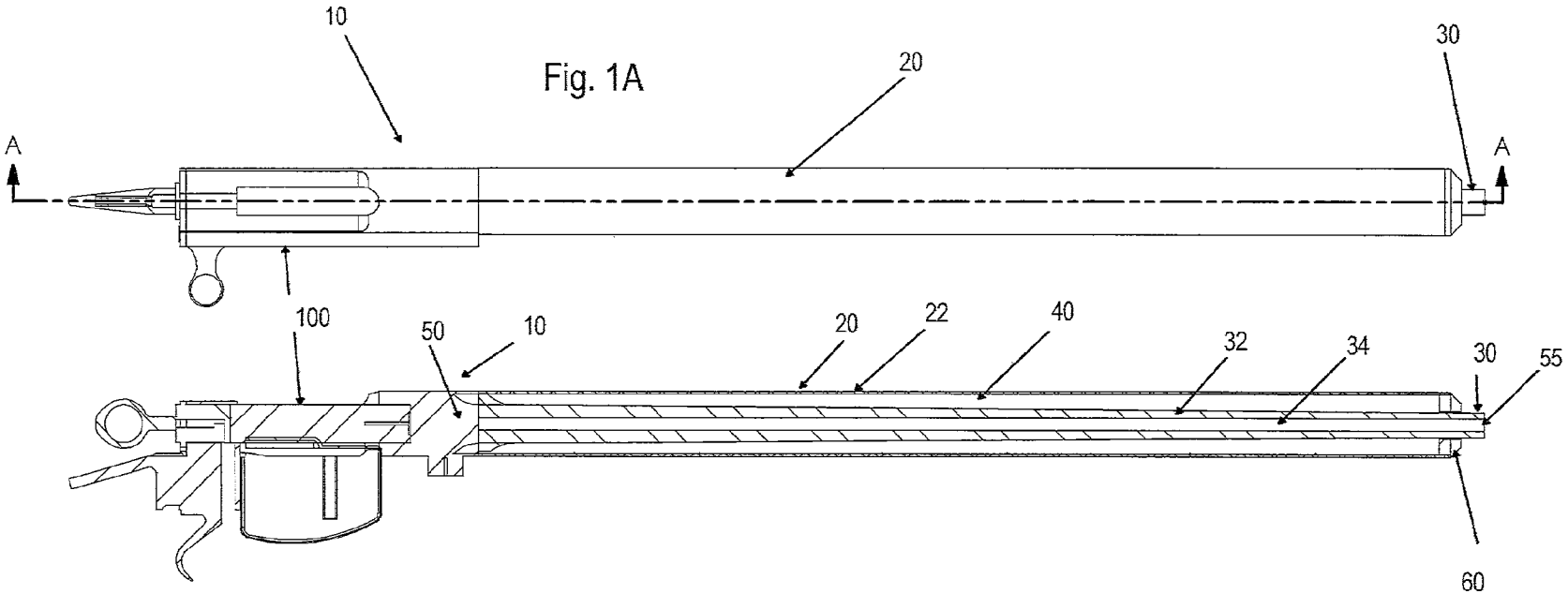
FIG. 1A is a top plan view of a rifle action and barrel having a harmonic barrel dampener according to at least one embodiment.
FIG. 1B is a cross section side plan view of the rifle action and barrel having a harmonic barrel dampener of FIG. 1A, cross sectioned along perspective line A-A according to at least one embodiment.
Figure 2:
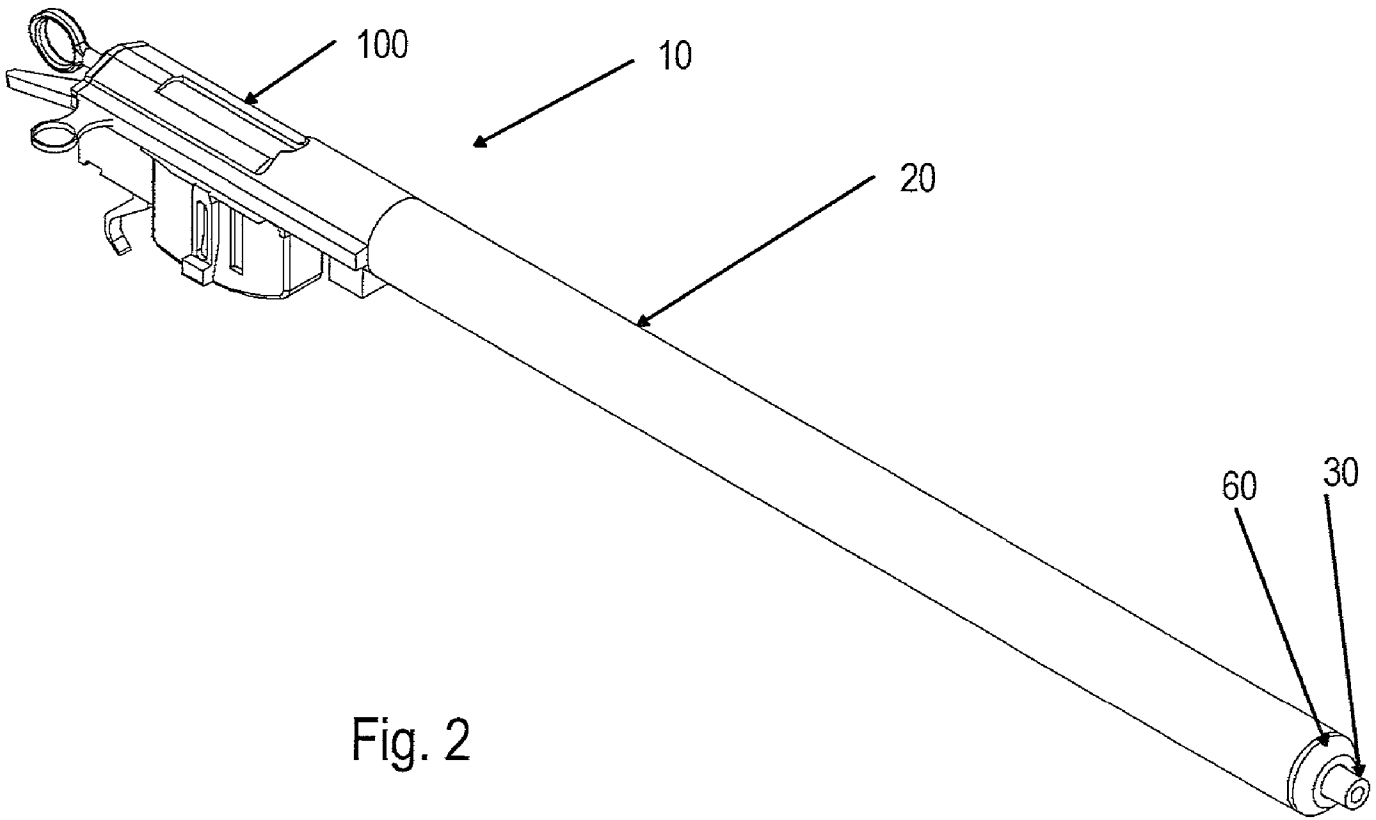
FIG. 2 is a perspective view of a rifle action and barrel having a harmonic barrel dampener according to at least one embodiment.

According to at least one additional embodiment, a harmonic barrel dampener is utilized. Turning now to FIGS. 1A and 1B, a harmonic barrel dampener 20 comprises an outer portion 22 that substantially encases or enwraps a significant portion of barrel 30, and optionally includes within its lumen an elastomeric or acoustic dampening material 40 to encase or substantially enwrap a substantial portion of the length of the barrel. In operation, any acoustic dampening material 40 at least partially fills the lumen of the harmonic barrel dampener 20 between the outer portion 22 and the exterior 32 of barrel 30.

According to at least one exemplary embodiment, acoustic dampening material 40 comprises a polymeric compound having the ability to dampen acoustic, vibrational, and/or heat anomalies of barrel 30 under normal operating conditions of a weapon. In at least one exemplary embodiment, a hollow tube comprising a metal, alloy, polymer, composite, fiberglass, and/or carbon fiber is selected such that the diameter of the hollow tube is large enough to encase barrel 30 along its length from approximately the distal end of the bullet chamber 50 to a point near the exit point of the barrel 55. By way of nonlimiting example, it will be appreciated that FIGS. 1A and 1B portray a 1.5 inch diameter aluminum tube as outer portion 22 of harmonic barrel dampener 20, as placed on a straight-pull action rifle, with harmonic barrel dampener 20 running approximately from the interface of the barrel 30 and rifle action 100.

In at least one embodiment, elastomeric or acoustic dampening material 40 comprises a polysulfide elastomeric material which retains elastomeric properties over a range of temperatures of at least −40° F. to 250° F., similar to that utilized for o-ring production on the space shuttle engines. According to at least one additional example, the elastomeric material retains elastomeric properties over a range of temperatures of between 0° C. and 100° C. For example, a two component chemically cured polysulfide sealant such as "Product 964" sold by Epoxy.com a Division of Epoxy Systems, Inc., 20774 W. Pennsylvania Ave., Dunnellon, Fla. 34431 may be used as the elastomeric or acoustic dampening material 40. In at least one embodiment, the two part polysulfide was poured into the hollow tube surrounding a rifle barrel, and allowed to cure until fully polymerized. Optionally, a retainer ring may be utilized to compress the hollow tube against the receiver of the rifle during curing of the two part polysulfide used as an elastomeric or acoustic dampening material 40, and may be used to compress the rifle barrel before and/or after the curing process to further reduce vibration.

Optionally, according to at least one other embodiment, a member operable to diffuse heat build-up between barrel 30 and elastomeric or acoustic dampening material 40 may be utilized. For example, a heat conducting material such as a metal mesh, ceramic matrix, carbon nano-tubes or other heat conductive component may be utilized at or near the interface between the elastomeric or acoustic dampening material 40 and exterior 32 of barrel 30. Further optionally, the heat conducting material may be attached to a heat sink or other heat-dissipating device.

According to at least one additional embodiment, the hollow tube or other device utilized to maintain the elastomeric or acoustic dampening material 40 around barrel 30 during the curing process may optionally be removed after the curing process, resulting in a harmonic barrel dampener that does not include an outer wall 22.

EXEMPLARY EMBODIMENTS

By way of nonlimiting examples, a Thompson Encore 1Z rifle, Springfield 1903A2 rifle and a Swiss K31 rifle were each retrofitted with a harmonic barrel dampener 20 according to at least one embodiment discussed above. Match ammunition designed for exceptional consistency and symmetry in combination with precisely weighed propellant powders assembled by repeatable methods with little variation were used to test each rifle, in both the unmodified and modified form. A variety of hand load Match ammunitions were used as specified for the given rifle, which included: Hornady 40 grain VMAX bullets of 0.223" diameter at approximately 3350 feet per second, Hornady 55 grain VMAX bullets of 0.223" diameter at 3280 feet per second, Sierra Match King 52 grain hollow point boat tail bullets of 0.223" diameter at velocities of 2900 to 3400 feet per second, and Hornady 168 grain hollow point boat tail match bullets of 0.308" diameter at velocities of 2400 to 2700 feet per second, and Swiss military surplus 172 grain full metal jacket bullets of 295" diameter at approximately 2570 feet per second, and was fired by a marksman at 100+/−1 yards. Example targets from each rifle from before and after the addition of the harmonic barrel dampener are included as FIGS. 3A, 4A, 5A, 6A, 7A, and 8A, with the results discussed in further detail below.

Example I

Turning now to FIGS. 3A-B and 4A-B, a Thompson Encore® rifle was used to fire many shots at targets 100 yards from the rifle using Hornady 40 grain Match bullets in the unmodified rifle. FIGS. 3A-B show an exemplary result from the test firing prior to adding the harmonic barrel dampener 20. FIGS. 4A-B display an exemplary result after a four shot session at 100 yards, using the same ammunition but modified with the harmonic barrel dampener 2.

Turning now to FIGS. 5A-B and 6A-B, for the same Thompson Encore® rifle in its unmodified state but shooting Hornady 55 grain VMAX bullets, a representative target is shown in FIG. 5A. However, the same rifle, modified with the harmonic barrel dampener and shooting the same match ammunition delivers the representative target shown at FIG. 6A.

Example II

A similar comparison is shown in FIGS. 7A-B and 8A-B for a 1903A3 Springfield rifle both examples of which are using Hornady 168 grain hollow point boat tail bullets. The representative target at FIG. 7A is of the rifle before modification while the target shown at FIG. 8A shows the improved repeatability and accuracy after the rifle has been improved by the addition of a harmonic barrel dampener 20.

Example III

In yet another embodiment, the scatter plots shown in FIGS. 9 and 10 aggregate several data points together, with FIG. 9 detailing the aggregated shots of an unmodified Swiss K31 rifle, while FIG. 10 aggregates shots using the same 172 grain surplus ammunition in the same rifle after the addition of a harmonic barrel dampener 20 according to at least one of the embodiments discussed above.

Summary of Exemplary Results

Table 1 below records and typifies the results across multiple rifles and multiple calibers all demonstrating significant improvements in accuracy and repeatability after the addition of the harmonic barrel dampener. The primary measure of improvement is based on a United States military standard of accuracy called the "mean radial dispersion." This measure is the average of each shot's distance from the virtual center of a target as defined by the shots made at the target, and is shown for each rifle before and after the addition of the harmonic barrel dampener 20. It should be noted mean radial dispersions of 1" to 1.5" are considered good for most military grade small bore weapons. Additionally, the Kolmogorov-Smirnov statistical test {which functions for samples taken from any continuous distribution function) applied here is a robust test of independence between the accuracy of the unmodified and stabilized rifles. The application of this test provides the probability the improved performance is real and not simply a unique random selection of the same distribution.

TABLE 1

| prototype | test condition | ammunition | sample size (rounds) | mean radial disperson (inches) | σ | Kolmogorov-Smirnov Test[1] |
|---|---|---|---|---|---|---|
| Thompson Encore | bare barrel | Hornady 40grain | 19 | 0.37 | 0.18 | D = 0.35 |
| Thompson Encore | dampend barrel | VMAX Hornady 40grain VMAX | 18 | 0.27 | 0.13 | |
| | | difference/ improvement | | 27% | 28% | 85% |
| Thompson Encore | bare barrel | VMAX 55grain | 19 | 0.68 | 0.27 | D = 0.61 |
| Thompson Encore | dampend barrel | VMAX 55grain | 17 | 0.37 | 0.19 | |
| | | difference/ improvement | | 46% | 30% | 100% |
| Springfield 1903A3 | | 168 grain Match | 28 | 0.60 | 0.22 | D = 0.76 |
| Springfield 1903A3 | | 168 grain Match | 15 | 0.30 | 0.12 | |
| | | difference/ improvement | | 49% | 45% | 100% |

TABLE 1-continued

| prototype | test condition | ammunition | sample size (rounds) | mean radial disperson (inches) | σ | Kolmogorov-Smirnov Test[1] |
|---|---|---|---|---|---|---|
| K31 Swiss | bare barrel | 168 grain Hornady | 22 | 0.81 | 0.50 | D = 0.50 |
| K31 Swiss | dampend barrel | 168 grain Hornady | 15 | 0.50 | 0.20 | |
| | | difference/ improvement | | 38% | 60% | 97% |
| K31 Swiss | bare barrel | 172 grain surplus | 27 | 1.56 | 0.92 | D = 0.91 |
| K31 Swiss | dampend barrel | 172 grain surplus | 15 | 0.47 | 0.16 | |
| | | difference/ improvement | | 70% | 83% | 100% |

In addition to the abovementioned improvements in accuracy, it should be noted that the addition of a harmonic barrel dampener according to at least one embodiment described above resulted in a significant reduction in the maximum external barrel temperature. In particular, the maximum external barrel temperature was reduced an average of 34%. This reduction will, at the very least, reduce the infrared signature of the weapon and increase the survivability of any soldier employing such an improvement on the firearm, and may ultimately help the variability of a rifle's aim-point which depends on the barrel temperature.

While specific embodiments have been disclosed herein, combinations of those embodiments, as well as certain variations thereof are included in the scope of this application. For instance, it is anticipated that a harmonic barrel dampener as disclosed herein will have similar results on other ballistic barrels beyond standard firearms. For example, tank and artillery barrels are anticipated to behave similarly and harmonic barrel dampeners are intended to encompass applications thereon.

What is claimed is:

1. A harmonic barrel dampener comprising:

an outer portion sized to substantially enwrap a selected weapon barrel, the outer portion having an interior chamber and an exterior portion; and an elastomeric dampening material substantially filling a volume defined by the interior chamber and an outer surface of a weapon barrel;

the dampening material capable of attenuating a spectrum of vibrational frequencies generated by the weapon barrel in operation.

2. The harmonic barrel dampener of claim 1, wherein the outer portion is of a length such that more than 75% of the length of the weapon barrel is substantially enwrapped therein.

3. The harmonic barrel dampener of claim 2, wherein the dampening material is an elastomeric polymer.

4. The harmonic barrel dampener of claim 3, wherein the dampening material is selected from a group consisting of epoxy and polysulfide.

5. The harmonic barrel dampener of claim 4, wherein the dampening material is poured into the volume defined by the interior chamber and an outer surface of a weapon barrel in an unpolymerized state and allowed to cure in situ.

6. The harmonic barrel dampener of claim 5, further comprising a retainer ring having an outer diameter approximately equal to a diameter of the outer portion, the retainer ring further comprising an opening sized such that the weapon barrel may protrude therethrough.

7. The harmonic barrel dampener of claim 6, wherein the retainer ring is operable to compress the weapon barrel.

8. The harmonic barrel dampener of claim 7, wherein the dampening material is cured while the barrel is compressed by the retainer ring.

9. The harmonic barrel dampener of claim 8, wherein the dampening material retains elastomeric properties over a range of temperatures of −40° F. to 250° F.

10. The harmonic barrel dampener of claim 8, wherein the harmonic barrel dampener is configured to improve an accuracy of a weapon barrel by at least 25% over a non-modified state when compared using a test selected from a group consisting of mean radial dispersion and Kolmogorov-Smirnov Test.

11. A harmonic barrel dampener comprising:

an outer portion sized to substantially enwrap a selected weapon barrel, the outer portion having an interior chamber and an exterior portion, wherein the outer portion is of a length such that more than 75% of the length of the weapon barrel is substantially enwrapped therein;

an elastomeric dampening material substantially filling a volume defined by the interior chamber and an outer surface of a weapon barrel, wherein the dampening material is an elastomeric polymer selected from a group consisting of epoxy and polysulfide;

a retainer ring having an outer diameter approximately equal to a diameter of the outer portion, the retainer ring further comprising an opening sized such that the weapon barrel may protrude therethrough, wherein the retainer ring is operable to compress the weapon barrel;

wherein the dampening material is operable to attenuate vibrations of the weapon barrel in operation when poured into the volume defined by the interior chamber and an outer surface of a weapon barrel in an unpolymerized state and allowed to cure in situ while the barrel is compressed by the retainer; and wherein the harmonic barrel dampener is configured to improve an accuracy of a weapon barrel by at least 25% over a non-modified state when compared using a test selected from a group consisting of mean radial dispersion and Kolmogorov-Smirnov Test.

* * * * *